US007926468B2

(12) United States Patent
Tanaka et al.

(10) Patent No.: US 7,926,468 B2
(45) Date of Patent: Apr. 19, 2011

(54) COLD START DEVICE FOR FUEL INJECTION PUMP

(75) Inventors: Masamichi Tanaka, Osaka (JP); Hiroyuki Machiyama, Osaka (JP)

(73) Assignee: Yanmar Co., Ltd., Osaka (JP)

( * ) Notice: Subject to any disclaimer, the term of this patent is extended or adjusted under 35 U.S.C. 154(b) by 203 days.

(21) Appl. No.: 12/299,651

(22) PCT Filed: Apr. 27, 2007

(86) PCT No.: PCT/JP2007/059203

§ 371 (c)(1),
(2), (4) Date: Dec. 18, 2008

(87) PCT Pub. No.: WO2007/129614

PCT Pub. Date: Nov. 15, 2007

(65) Prior Publication Data

US 2009/0133670 A1 May 28, 2009

(30) Foreign Application Priority Data

May 9, 2006 (JP) ..... 2006-130781

(51) Int. Cl.
*F02M 37/04* (2006.01)
*F02M 37/06* (2006.01)

(52) U.S. Cl. ..... 123/495; 123/357

(58) Field of Classification Search ..... 123/495, 123/502, 357, 479, 491, 179.17, 406.76; 701/104, 105, 107
See application file for complete search history.

(56) References Cited

U.S. PATENT DOCUMENTS

| | | | | |
|---|---|---|---|---|
| 4,368,705 | A * | 1/1983 | Stevenson et al. | 123/357 |
| 4,489,698 | A * | 12/1984 | Hofer et al. | 123/502 |
| 4,630,588 | A * | 12/1986 | Sagawa et al. | 123/506 |
| 5,655,502 | A * | 8/1997 | Enomoto et al. | 123/502 |
| 7,051,706 | B2 * | 5/2006 | Tanaka et al. | 123/357 |
| 7,121,245 | B2 * | 10/2006 | Tanaka et al. | 123/179.17 |
| 7,152,585 | B2 * | 12/2006 | Tanaka | 123/500 |
| 7,350,503 | B2 * | 4/2008 | Tanaka et al. | 123/362 |
| 2006/0048750 | A1 * | 3/2006 | Tanaka et al. | 123/357 |
| 2006/0112936 | A1 * | 6/2006 | Tanaka et al. | 123/501 |
| 2009/0012701 | A1 * | 1/2009 | Machiyama et al. | 701/113 |

FOREIGN PATENT DOCUMENTS

| | | |
|---|---|---|
| JP | 63-28231 | 6/1988 |
| JP | 2004-316486 | 11/2004 |
| JP | 2005-002912 | 1/2005 |

OTHER PUBLICATIONS

JP 2004316488 (Tanaka et al.) Nov. 11, 2004 (abstract). [online] [retrieved on Sep. 7, 2010]. Retrieved from JPO Database.*
International Search Report for PCT/JP2007/59203 from the Japanese Patent Office dated Aug. 7, 2007, 1 pg.

* cited by examiner

*Primary Examiner* — Mahmoud Gimie
(74) *Attorney, Agent, or Firm* — Sterne, Kessler, Goldstein & Fox P.L.L.C.

(57) ABSTRACT

A fuel injection pump provided with a diesel engine having a starter started up by a key switch. The fuel injection pump comprises a cold start device having a sparking actuator, the starter and the sparking actuator. The fuel injection pump includes an activator that activates the sparking actuator whenever the key switch is switched on.

2 Claims, 4 Drawing Sheets

COLD START DEVICE FOR FUEL INJECTION PUMP

BACKGROUND OF THE INVENTION

1. Field of the Invention

The present invention relates to a technology for improving a credibility of operating a cold start device in a fuel injection pump for a diesel engine equipped with the cold start device.

2. Background Art

Conventionally, there are well-known fuel injection pumps for diesel engines, comprising a plunger, a plunger barrel, wherein the plunger is vertically reciprocated in the plunger barrel so as to send pressurized fuel to the distribution shaft, the distribution shaft delivers it to a plurality of delivery valves, and the respective delivery valves send the fuel to fuel injection nozzles.

Some of the well-known fuel injection pumps include cold start devices ("Cold Start Device", hereinafter, referred to as "CSD"), wherein an overflowing sub-port is formed and a sparking actuator is operated by a controller, thereby opening and closing the overflowing sub-port so as to change an injection timing.

Due to the CSD, when started up in a low temperature, a starting performance of an engine is improved by closing the sub-port so as to accelerate the injection timing, i.e., by performing a sparking control. The overflowing sub-port is a port so as to communicate a fuel pressure chamber with a hypobaric chamber (a low pressure oil passage). The coupling and decoupling of the fuel pressure chamber with the hypobaric chamber are performed by operating the CSD piston interposed between both chambers with the sparking actuator and the like.

However, the CSD is not operated during the summer seasons because it makes it a rule to operate only when started up in a low temperature during the winter seasons and the like, thereby causing a possibility of fixing the CSD piston with the sliding surface of the piston barrel due to the deterioration of the fuel and the like. That is to say, when the CSD is operated for a long time, there is a problem of detracting a credibility of operating the CSD piston.

Therefore, as disclosed in JP 2004-316486, the credibility of operating the CSD piston is improved by operating the CSD with the arbitrary manipulation of the operator even if started up in a low temperature.

However, it is preferable not only to operate the CSD but also to confirm a fault of it in a warm temperature so as to improve the credibility of operating the fuel injection pump.

Also, the CSD sometimes exerts a harmful influence on the diesel engine by arbitrarily operating it because the operation of it affects the amount of fuel consumption. For example, an excessive amount of fuel consumption when starting up the diesel engine causes a black smoke degeneration.

Accordingly, the problem so as to be solved is to confirm the fault of the CSD in order to improve the credibility of the fuel injection pump without affecting the amount of fuel consumption.

BRIEF SUMMARY OF THE INVENTION

The problem so as to be solved by the present invention is as mentioned above. Next, the means of solving the problem will be described.

The present invention is equipped with a diesel engine having a starter operated by a key switch. In a fuel injection pump having a cold start device in the sparking actuator, the present invention turns the sparking actuator on and off whenever the key switch is turned on and includes the means of confirming that the sparking actuator was turned on and off.

Additionally, in the present invention, the starter is started up after the sparking actuator is turned on and off by receiving a start signal from the controller.

The present invention shows the following effects.

In the present invention, the CSD can be confirmed the fault of it even when it is started up in a warm temperature by operating the CSD and by preventing the faults such as the fixation and the like, as well as by performing the fault detection of the CSD whenever the starter is started up. In other words, the credibility of the fuel injection pump can be improved.

Moreover, in the present invention, in addition to the above-mentioned effects, the CSD can be confirmed the fault of it by operating the CSD before driving the starter and by allowing the amount of fuel consumption by the operation of the CSD without affecting the diesel engine. In other words, the credibility of the fuel injection pump during the fault identification can be improved.

BRIEF DESCRIPTION OF THE DRAWINGS

FIG. 2 is a sectional side view of the CSD when the CSD is turned on.

DETAILED DESCRIPTION OF THE INVENTION

Figure 1:
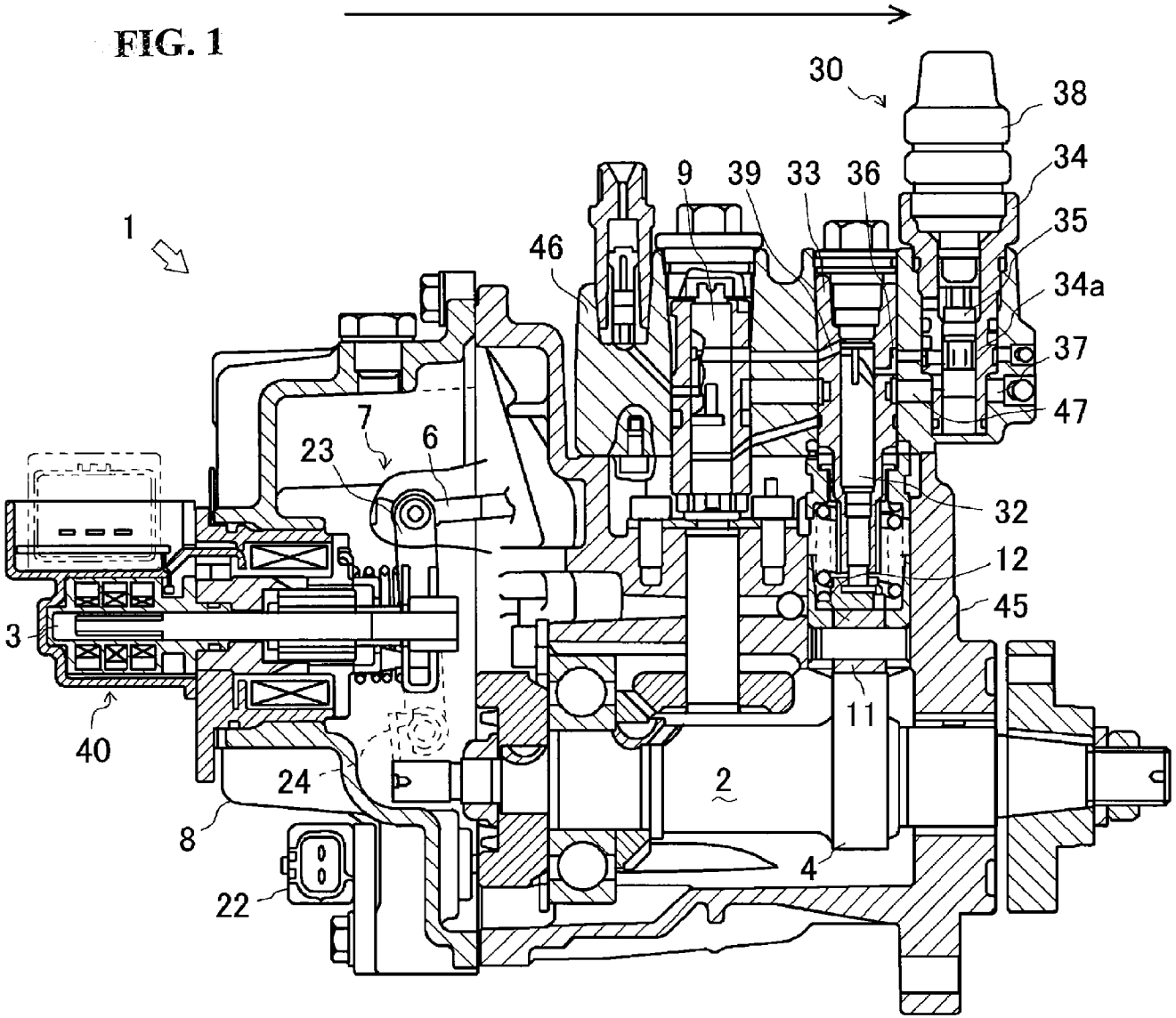
FIG. 1 is a sectional side view of an entire construction of a fuel injection pump according to an embodiment of the present invention.
Figure 2:
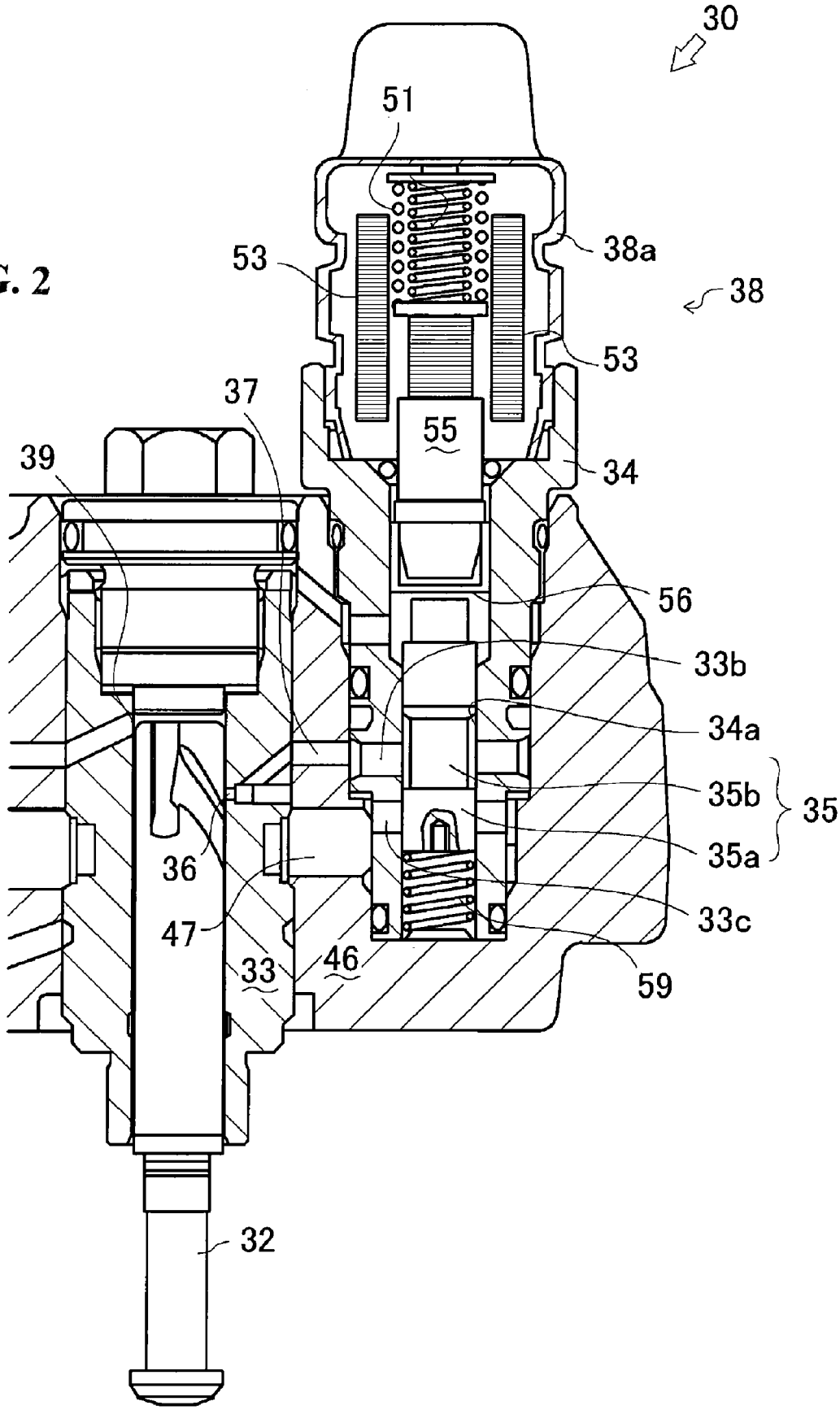
Figure 3:
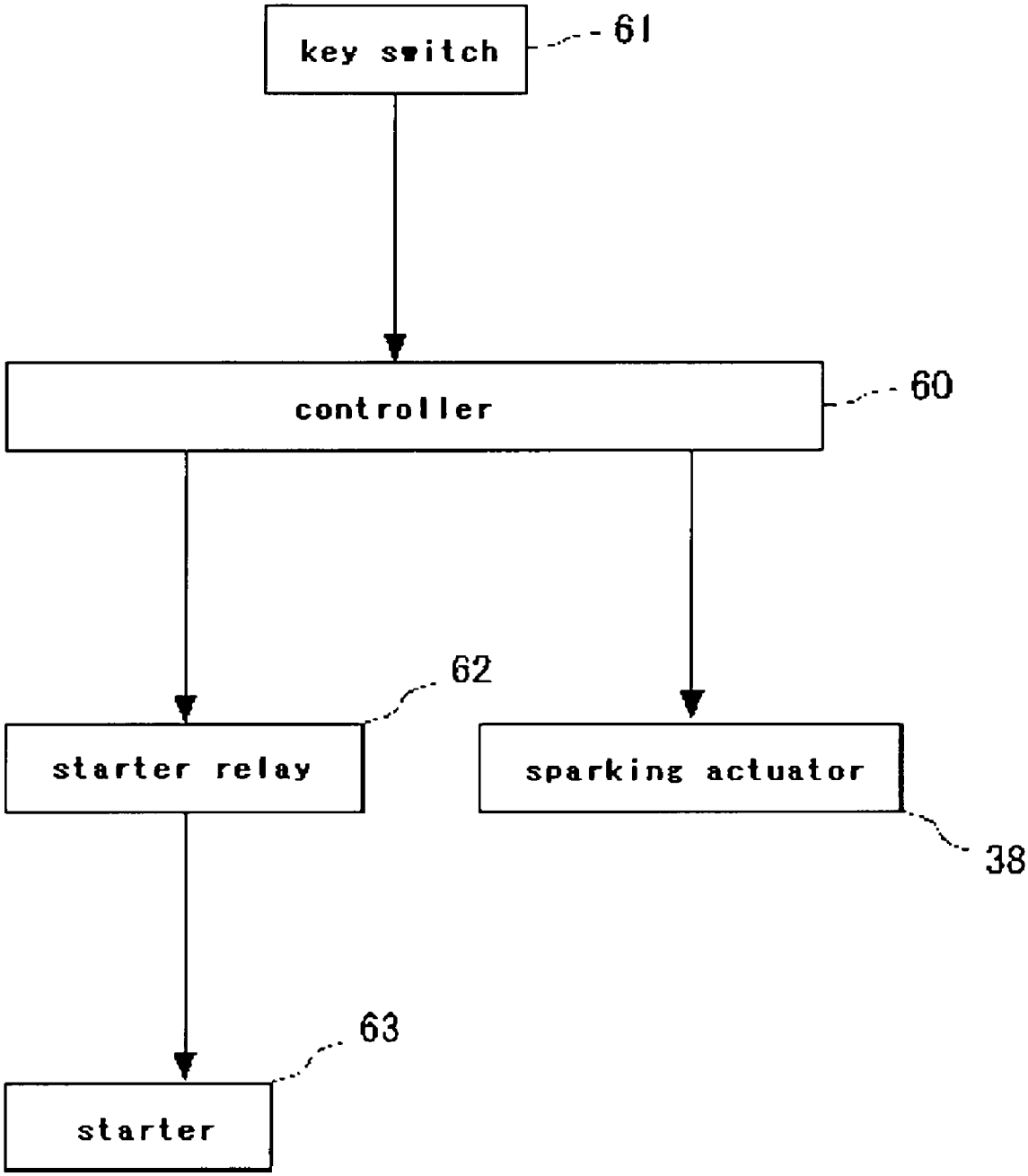
FIG. 3 is a block diagram showing a construction of a controller of a diesel engine according to an embodiment of the present invention.
Figure 4:
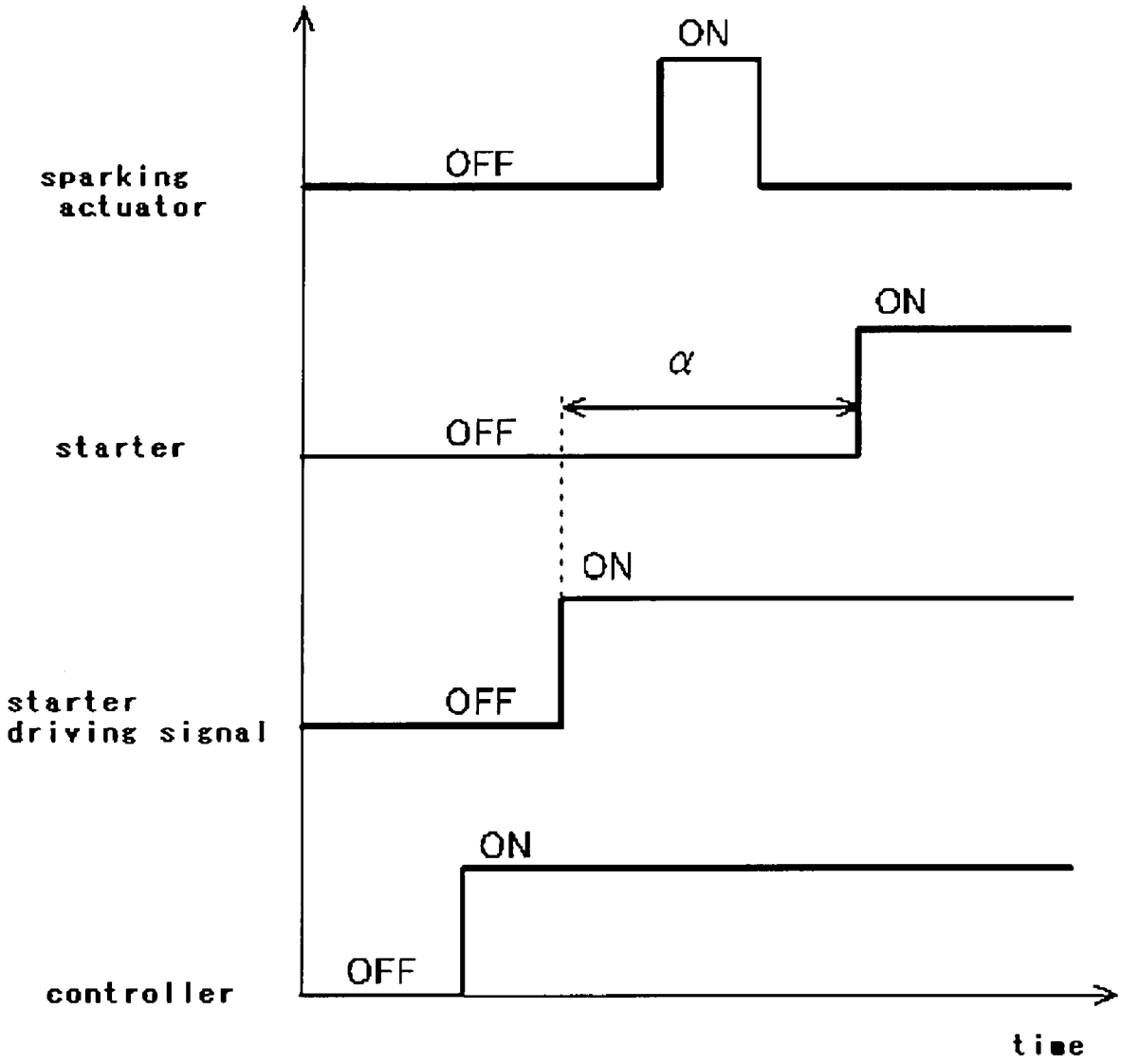
FIG. 4 is a graph chart showing operating conditions of the respective actuators when starting up the diesel engine.

Next, embodiments of the present invention will be described. FIG. 1 is a sectional side view of an entire construction of a fuel injection pump according to an embodiment of the present invention. FIG. 2 is a sectional side view of the CSD when the CSD is turned on. FIG. 3 is a block diagram showing a construction of a controller of a diesel engine according to an embodiment of the present invention. FIG. 4 is a graph chart showing operating conditions of the respective actuators when starting up the diesel engine.

A fuel injection pump 1 and a cold start device (hereinafter, referred to as CSD 30) used in the diesel engine will be described in this order, so as to explain the embodiments according to the present invention. Incidentally, the direction of an arrow is referred to as a longitudinal direction so as to simplify the description in FIG. 1.

With reference to FIG. 1, the construction of the fuel injection pump 1 according to the present invention will be described. As shown in FIG. 1, in the fuel injection pump 1, a pump housing 45 and a hydraulic head 46 are vertically engaged, a casing 8 of an electronically-controlled governor device 7 is provided in the rear side of the pump housing 45, and a rack actuator 40 is inserted and fixed on the left side of the casing 8.

In the rack actuator 40, the apical end portion of the sliding shaft 3 is pivoted on the midstream of a link lever 23, the lower part of the link lever 23 is rotatably arranged around a base pin 24, and the front end portion of a control lever 6 is pivoted on the upper end portion of the link lever 23.

Due to the above construction, the movement of the sliding shaft 3 in the longitudinal direction, the rotation of the link lever 23 around the base pin 24 in the longitudinal direction and the movement of the control lever 6 in the longitudinal direction are interlocked, so as to operate an adjustment rack (not shown) rotating a plunger 32 and change the position of it to a plunger lead by the driving of the adjustment rack. Thus, the increase and decrease of the amount of fuel consumption by the fuel injection pump 1 is regulated.

Also, a rotation number sensor 22 is attached to the lower portion of the casing 8 so as to detect the rotation number of a pump camshaft 2.

A plunger barrel 33 is inserted and fixed into the hydraulic head 46, and the plunger 32 is vertically slidably inserted into the plunger barrel 33.

Also, the plunger 32 is vertically moved via a tappet 11 and a lower spring bearing 12 by the rotation of the cam 4 formed on the pump camshaft 2, thereby supplying a distribution shaft 9 with the compressed fuel from the main port 39 of the plunger barrel 33.

Moreover, a piston barrel 34 of the cold start device (hereinafter, referred to as "CSD 30") is inserted and fixed into the lateral side of the plunger barrel 33 in the hydraulic head 46, and a CSD piston 35 is vertically slidably provided in a sliding portion 34*a* of the piston barrel 34, thereby vertically sliding the CSD piston 35 by the sparking actuator 38.

With reference to FIG. 2, the CSD will be described in detail. In the CSD, an armature 55, which is moved up and down by conducting of exciting coils 53, is disposed in the case 38*a* of the sparking actuator 38. The lower end surface of the armature 55 comes into contact with the upper end surface of the CSD piston 35 via a holder 56. A spring 51 comes into contact with the upper end surface of the armature 55 and downwardly depresses it. A spring 59, which is disposed on the under side of a piston sliding portion 34*a* of the piston barrel 34, depresses upwardly the lower end surface of the CSD piston 35.

In this regard, the suppress strength by the spring 51 is set up to be stronger than that of the spring 59.

Likewise, with reference to FIG. 2, the on/off operation of the CSD 30 will be described. As shown in FIG. 2, one of the overflowing sub-port 36 formed in the plunger barrel 33 can be communicated with a fuel-pressurizing chamber in the plunger barrel 33. The other of the overflowing sub-port 36 is connected to the piston barrel 34 via a drain oil passage 37 of the hydraulic head 46 and a high-pressure port 33*b* of the piston barrel 34. Also, in the piston barrel 34, a low-pressure port 33*c*, which is open under the high-pressure port 33*b*, is communicated with the low-pressure chamber 47 in the hydraulic head 46.

In this regard, the lower portion of the CSD piston 35 is composed of a lower large diameter portion 35*a* that is substantially identical to the inner diameter of the piston sliding portion 34*a* in diameter so as to close the low pressure port 33*c*, when the CSD 30 is turned on, that is to say, when the CSD 30 is in the highest position.

Meanwhile, the longitudinal substantially central portion of the CSD piston 35 is composed of a central small diameter portion 35*a* that is smaller than the inner diameter of the piston sliding portion 34*a* in diameter so as to connect the high-pressure port 33*b* to the low-pressure port 33*c*, when the CSD 30 is turned off, that is to say, when the CSD 30 is in the lowest position (not shown).

Due to the above construction, when the sparking actuator 38 is operated (the CSD 30 is turned on) (see FIG. 2), the armature 55 is moved up toward the suppress strength by the spring 51. As the armature 55 is moved up, the CSD piston 35 is moved up by the suppress strength of the spring 59, thereby disengaging the connection of the overflowing sub-port 36 with the low-pressure chamber 47 in the hydraulic head 46 via the drain oil passage 37. Accordingly, the overflow from the overflowing sub-port 36 when the plunger 32 is moved up is stopped, thereby performing a spark control on the injection timing.

On the other hand, when the sparking actuator 38 is not operated (the CSD 30 is turned off) (not shown), the armature 55 is moved down by the suppress strength of the spring 51 (toward the suppress strength by the spring 59). As the armature 55 is moved down, the CSD piston 35 is moved down, thereby engaging the connection of the overflowing sub-port 36 with the low-pressure chamber 47 via the drain oil passage 37. Accordingly, some of the fuels compressed by the plunger 32 are overflowed to the low-pressure chamber 47 so as to set up the normal injection timing.

With reference to FIG. 3, the control construction of the fuel injection pump 1 and the compression ignition oil engine including the diesel engine according to the present invention will be described.

As shown in FIG. 3, a key switch 61, a sparking actuator 38 of the CSD 30 and a starter relay 62 that engage and disengage a circuit of a starter 63 activating the engine are connected to the controller 20. In this regard, the starter relay 62 is a relaying device that engages and disengages the circuit of the starter 63, and the key switch 61 is a switch that turns on and off the diesel engine with the key. In this regard, the rotation number sensor 22, the rack actuator 40 and the like are connected to the controller 60, but they are not shown in FIG. 3 so as to briefly describe.

Due to the above construction, the controller 60 is turned on and off by the key switch 61. In addition, the controller 60 can control the on/off timing of the starter 63 and the sparking actuator 38.

With reference to FIG. 4, a fault detection control of the CSD as an embodiment of the present invention will be described.

FIG. 4 is a graph chart, wherein a horizontal scale is a time course and a longitudinal scale shows operations of the respective actuators illustrated in FIG. 3.

First, when the key switch 61 is switched on, the controller 60 is turned on. Next, the controller 60 transmits a driving signal to the starter relay 62. At this time, the starter 63 drives after a lapse of check time a when the driving signal is transmitted. During the check time $\alpha$, the controller 60 turns the sparking actuator 38 on and off and performs a fault diagnosis $\beta$ if the sparking actuator 38 can be turned on electricity. Finally, after the lapse of check time $\alpha$, the starter 63 is turned on, thereby activating the diesel engine.

In this regard, as a result of the fault diagnosis $\beta$, when the controller 60 cannot confirm that the sparking actuator 38 is turned on electricity and it has a possibility of a disconnection and the like, the controller 60 warns an operator. Examples of warning methods include, but are not especially limited to a warning light and the like in the present invention.

The CSD 30 is an actuator that operates only when started up in a low temperature and thus, it is difficult to perform the fault detection in warm temperature. Consequently, as described in an embodiment of the present invention, the fault detection of the CSD is performed whenever the diesel engine is started up, regardless of the engine temperature (cold or warm), thereby improving the credibility of the fuel injection pump 1.

Also, the CSD 30 is a device that changes the amount of fuel consumption when it is turned on and off. If the CSD is turned on and off just when the engine is started up so as to perform the fault detection, the excessive amount of fuel consumption would be supplied with the diesel engine, thereby causing a black smoke degeneration. Consequently, as described in the embodiment of the present invention, because the starter 63 has the check time α, the CSD 30 is turned on and off while started up the starter 63 is certainly stopped, that is to say, while the diesel engine is stopped, so as to improve the security during the fault detection.

Moreover, in the embodiment of the present invention, because the fault is detected not only by energizing the sparking actuator 38 but also by actually turning the sparking actuator 38 on and off, the operator can confirm the operation of the sparking actuator 38 by checking the on/off switch-over sound. Accordingly, the fault can be detected not only by the controller 60 but also by the sense of hearing of the operator, thereby improving the security of the fuel injection pump 1.

INDUSTRIAL APPLICABILITY

The present invention can be available in the engine equipped with the cold start device.

The invention claimed is:

1. A fuel injection pump, comprising:

a cold start device comprising a sparking actuator, wherein the fuel injection pump is connected to a diesel engine having a starter started by a key switch, and wherein the sparking actuator is configured to be turned on and off when the key switch is switched on; and a means of confirming that the sparking actuator was successfully turned on and off.

2. The fuel injection pump as set forth in claim 1, wherein the starter is started up after the sparking actuator is turned on and off by receiving a start signal from a controller.

* * * * *